US009550599B2

(12) United States Patent
Alther et al.

(10) Patent No.: US 9,550,599 B2
(45) Date of Patent: Jan. 24, 2017

(54) CONTAINER AND METHOD FOR PRODUCING A CONTAINER

(75) Inventors: Roger Alther, Flurlingen (CH); Marco Pluess, Schaffhausen (CH); Holger Poell, Schaffhausen (CH)

(73) Assignee: SIG Technology AG, Neuhausen am Rheinfall (CH)

( * ) Notice: Subject to any disclaimer, the term of this patent is extended or adjusted under 35 U.S.C. 154(b) by 840 days.

(21) Appl. No.: 13/641,002

(22) PCT Filed: Apr. 5, 2011

(86) PCT No.: PCT/EP2011/055276

§ 371 (c)(1),
(2), (4) Date: Dec. 21, 2012

(87) PCT Pub. No.: WO2011/128229

PCT Pub. Date: Oct. 20, 2011

(65) Prior Publication Data

US 2013/0193138 A1 Aug. 1, 2013

(30) Foreign Application Priority Data

Apr. 14, 2010 (DE) ..... 10 2010 014 993

(51) Int. Cl.
*B29C 45/14* (2006.01)
*B65D 1/40* (2006.01)
(Continued)

(52) U.S. Cl.
CPC . *B65D 1/40* (2013.01); *B65D 3/08* (2013.01); *B65D 3/26* (2013.01); *B65D 15/04* (2013.01)

(58) Field of Classification Search
CPC .... B29C 66/534; B29C 65/0672; B29C 65/02; B29C 65/08; B29C 65/06
(Continued)

(56) References Cited

U.S. PATENT DOCUMENTS 3,434,644 A * 3/1969 Collie ..... B65D 11/10 215/379
3,657,044 A 4/1972 Singer
(Continued)

FOREIGN PATENT DOCUMENTS

CN 1390754 A 1/2003
CN 1863707 A 11/2006
(Continued)

*Primary Examiner* — Fenn Mathew
*Assistant Examiner* — Cynthia Collado
(74) *Attorney, Agent, or Firm* — The Webb Law Firm

(57) ABSTRACT

The invention relates to a container for receiving contents, in particular liquid foods, having a tubular main body and having at least one molded fiber part connected to the main body, and to a method for producing such a container. For the container to be suitable for being aseptically filled with liquid or paste-like foods, the inner face of the at least one molded fiber part is coated to be gas and liquid tight. The container is produced as follows: pressing at least one molded fiber part from pulp, coating the inner face(s) of the molded fiber part or parts, providing the tubular main body, connecting the main body to the (first) molded fiber part for generating a container that is open on one side, filling the container through the open side, and closing the container by folding or by joining to the (further) molded fiber part.

11 Claims, 6 Drawing Sheets

(51) Int. Cl.
*B65D 3/08* (2006.01)
*B65D 3/26* (2006.01)
*B65D 8/00* (2006.01)

(58) Field of Classification Search
USPC ..... 220/613, 600, 610; 53/558, 452, 467, 53/473, 266.1, 285; 229/5.5, 4.5, 43, 5.7, 5.6, 229/106, 107; D9/424, 523; 264/252, 257, 275
See application file for complete search history.

(56) References Cited

U.S. PATENT DOCUMENTS 4,337,104 A * 6/1982 Lynn ..... C12M 23/28 156/244.13
4,356,926 A * 11/1982 Priestly ..... B29C 65/44 156/73.1
4,434,908 A * 3/1984 French ..... B65D 17/163 220/270
4,527,699 A * 7/1985 Namba ..... B65D 15/22 215/12.2
4,564,139 A * 1/1986 Reil ..... B65D 3/02 222/530
4,844,327 A 7/1989 Rausing
5,088,642 A 2/1992 Faerber
5,356,518 A * 10/1994 Kelley ..... D21J 7/00 162/223
8,003,033 B2 8/2011 Elgebrant
2009/0321297 A1 12/2009 Sundblad et al.

FOREIGN PATENT DOCUMENTS

CN 101001785 A 7/2007
DE 3942319 A1 6/1991
EP 0223094 A2 5/1987
EP 0893355 A2 1/1999
WO 2007111567 A1 10/2007

* cited by examiner

CONTAINER AND METHOD FOR PRODUCING A CONTAINER

BACKGROUND OF THE INVENTION

Field of the Invention

The invention relates to a container for receiving contents, in particular liquid foodstuffs, comprising a tubular base body and comprising at least one fibrous moulding connected to the base body as cover or base of the container, as well as a method for producing such a container.

Description of the Related Art

For a long time foodstuffs have been made to keep by freeing them from bacteria. This process is designated as sterilisation and is frequently accomplished by heating or by treatment with steam. Sterilised foodstuffs are preferably filled in containers or packages which are also sterilised.

Unlike in the case of fresh foodstuffs which are consumed within a short time anyway, preferably aseptically filled packages are used for sterilised foodstuffs to keep the contents bacteria-free.

On the one hand, "aseptic packages" are intended to prevent the ingress of micro-organisms and oxygen into the package. In addition, aseptic packages are intended to prevent or suppress the multiplication of micro-organisms remaining in the foodstuff despite sterilisation. Aseptic packages must therefore have special material properties compared with conventional packages.

Various aseptic packages are known from practice. Frequently, the material of these packages comprises expensive laminates, that is a plurality of material layers joined together flat.

In order to keep the contents bacteria-free and ensure a long shelf life, in laminates for aseptic packages layers of plastic and aluminium are frequently used along with a carrier layer of cardboard or paper. In addition to high material costs, this has the disadvantage that the layers are difficult to separate from one another after use in order to reuse the materials isolated from one another as recyclable materials.

A particularly environmentally friendly material for packages is pulp. Pulp comprises a fibrous mass of cellulose. Solid fibrous mouldings for packages and containers can be pressed from pulp under the action of pressure and heat. These containers can certainly be very easily used again as recyclable material but as a result of their permeability are unsuitable as aseptic packages.

Known from U.S. Pat. No. 5,356,518 is a multipart container in which the upper part and the lower part are fibrous mouldings pressed from pulp.

EP 0 893 355 A2 discloses a multipart container in which the upper part is formed from coated paper.

Known from U.S. Pat. No. 4,527,699 is a multipart container with an upper part made of plastic.

DE 39 42 319 A1 discloses a container for liquids made of cardboard-plastic composite material.

Known from WO 2007/111567 A1 is a tray made of a coated fibrous moulding.

U.S. Pat. No. 3,657,044 discloses a fibrous moulding having a coating.

The containers described are not readily suitable for the aseptic filling of liquid or pasty foodstuffs.

It is therefore the object of the invention to configure and further develop the container mentioned initially such that the container is suitable for the aseptic filling of liquid or pasty foodstuffs and to provide a method for producing such a container.

SUMMARY OF THE INVENTION

This object is solved by a container wherein the inner side of the at least one fibrous moulding is coated in a gas- and liquid-tight manner by means of a multilayer film which can also contain a barrier layer and that the film is guided around the edge of the fibrous moulding in an overlap region in which the base body surrounds the fibrous moulding. Such a coating makes it possible to use the container for an aseptic, therefore bacteria-free, filling and storage of liquid or pasty foodstuffs. The coating can comprise in particular a plastic film, a barrier layer, a multilayer film, a chemical coating or a varnish. The "aseptic coating" protects the contents of the container from influences which stimulate the multiplication of micro-organisms. These influences in particular comprise light, air and oxygen. In addition, the coating should prevent the ingress of new micro-organisms, in particular new germs or bacteria. Micro-organisms frequently enter via the ambient air or via liquids into the package. Thus, the coating can in particular be a gas barrier, a liquid barrier or an oxygen barrier. The coating can have the said properties individually or in combination.

The connection between the tubular base body and the fibrous moulding can in particular be produced by an interior or an exterior fibrous moulding. In other words, the base body surrounds the fibrous moulding or the fibrous moulding surrounds the base body. The tubular base body is frequently designated as jacket in the packages concerned. It can also be formed as a tube and folded. The connection between base body and fibrous moulding can be made by various joining methods known as such, in particular by adhesive bonding, welding (ultrasound, high-frequency, infrared, screw welding) as well as by means of hot air, thermal radiation or the like.

It can be provided that the base body is made of packaging laminate. In particular, cardboard, paper, board and plastics can be used as packagings. The packaging can in particular comprise a laminate which can consist of several layers of different materials.

It is possible that the packaging has at least one layer of board, paper, plastic or aluminium. The packaging can comprise materials which are usually used for composite packagings. Depending on the requirements, in particular the materials board, paper, plastic or aluminium can be used and combined in one layer or in several layers. The layers each fulfil an important function for product protection. A layer which protects the contents from specific influences is also designated as barrier layer. A barrier layer can in particular be formed from aluminium foil, SiOx, aluminium vapour deposition, PA, EVOH or another barrier plastic. A plastic layer can form a liquid barrier for the product and keep away moisture. A carton layer of board or paper can give the container a high stability. An aluminium layer can protect the contents from light, external aromas and oxygen. The contents, the natural flavour and the colour of the contents are thus preserved for a long time.

It can be provided that each fibrous moulding is made from pulp. Pulp comprises a fibrous mass consisting of cellulose which forms an important raw material in paper manufacture. The use of pulp enables the consumption of plastics and metals to be reduced in the manufacture of the container. Pulp comprises a renewable raw material so that in a pulp-based container the fraction of renewable materials is high. A fibrous moulding made from pulp is therefore readily recyclable. In addition, these fibrous mouldings made of pulp can be pressed into almost any shape. An attractive design of the container is possible by means of a variable design and shaping of the fibrous moulding.

In a further embodiment of the invention, the fibrous moulding is the upper part of the container. In packages the upper part is frequently also designated as gable. The upper part can have a pouring opening for mounting a pouring element or be formed as the pouring element itself. The pouring element can be used for the first opening of the container and also be designed to be re-closable. Depending on the dimension of the pouring element, the upper part can have a small or a large pouring opening.

It can be provided that each fibrous moulding is the base part of the container. The base part is preferably formed so that it enables secure standing and easy stacking of the containers.

Another embodiment provides that the outer side of the at least one fibrous moulding is completely or partially provided with a coating. The coating of the outer side can consist of the same materials and fulfil the same function as the previously described coating of the inner side of the fibrous moulding. It can comprise an aseptic coating as has been described previously.

It can also be provided that the overlap region of the fibrous moulding is provided with a coating. In addition to the inner and the outer side, the fibrous moulding is delimited by at least one edge which is frequently configured as a narrow edge surface. Edge is to be understood not only as a single, outer circumferential edge. On the contrary the fibrous moulding can also have an inner edge which approximately delimits a pouring opening for mounting a pouring element. The coating can span and cover the pouring opening. It can comprise an aseptic coating as has been described previously.

A further teaching of the invention provides that the coating is a film which can also be designed as multilayer and also contain a barrier layer. Here it is particularly expedient if the film is guided around the edge of the fibrous moulding as will be described in detail further below.

The object is solved according to the method by a method for manufacturing a container comprising a base body and comprising at least one fibrous moulding, by the following steps:

- pressing at least one fibrous moulding from pulp,
- coating the inner side(s) of the fibrous moulding(s),
- providing the tubular base body,
- joining the tubular base body to the (first) fibrous moulding to produce a container open on one side,
- filling the container through the open side,
- closing the container by folding or by joining to the (further) fibrous moulding.

Alternatively, the object is solved by a method for manufacturing a container comprising a base body and comprising at least one fibrous moulding having a pouring opening, by the following steps:

- pressing at least one fibrous moulding from pulp,
- coating the inner side(s) of the fibrous moulding (s),
- providing the tubular base body (1),
- joining the tubular base body (1) to the fibrous moulding(s) to produce a container,
- filling the container through the pouring opening,
- closing the pouring opening.

The invention is explained in detail hereinafter with reference to drawings showing merely preferred exemplary embodiments.

DETAILED DESCRIPTION OF THE EMBODIMENTS

Figure 1:
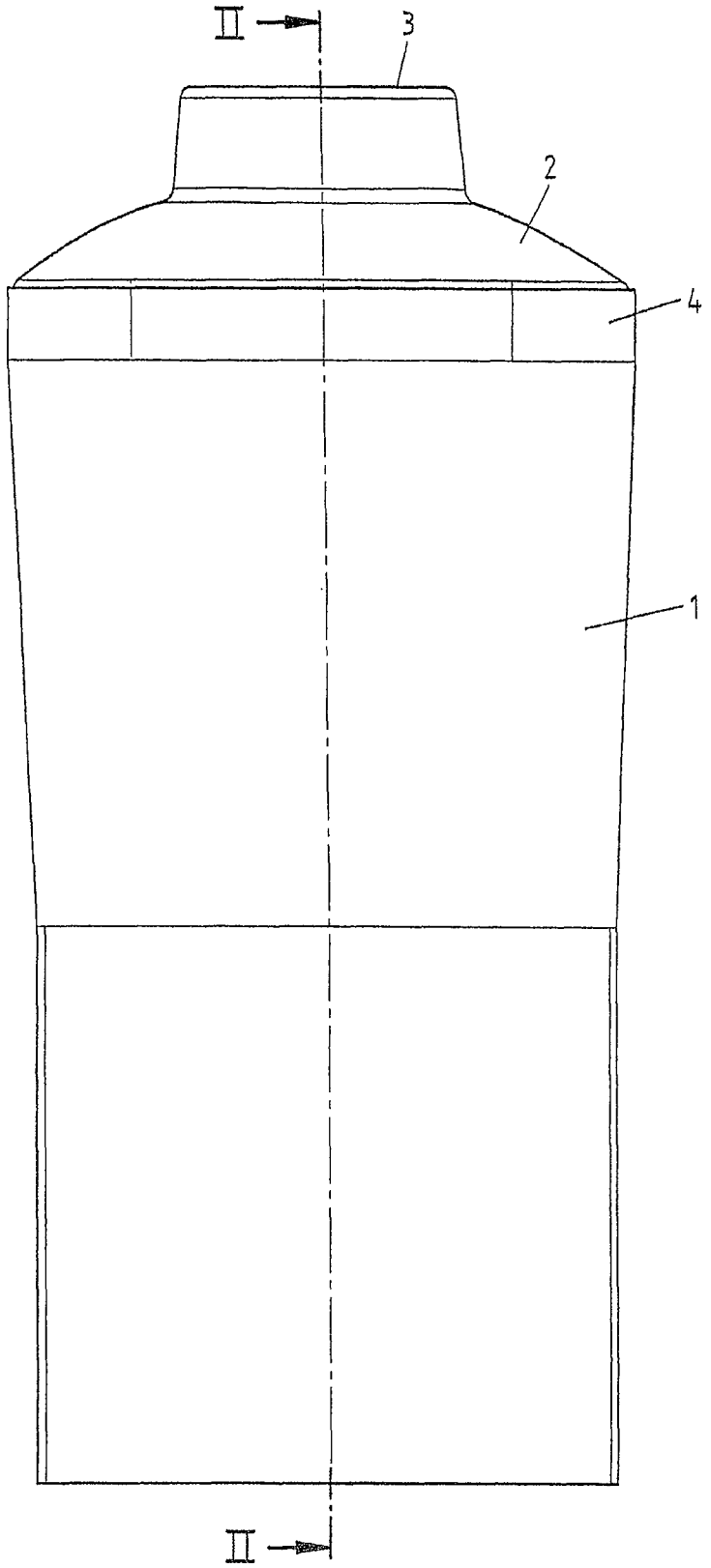
FIG. 1 shows a base body and an upper part of a container joined to the base body in side view.

FIG. 1 shows a base body 1 of a container which is connected to an upper part 2 of the container, in side view. The upper part 2 is a fibrous moulding pressed from pulp and in the preferred exemplary embodiment shown is provided with a pouring opening 3. The connection between base body and upper part is produced by the base body 1 surrounding the upper part 2 in an overlap region 4.

Figure 2:
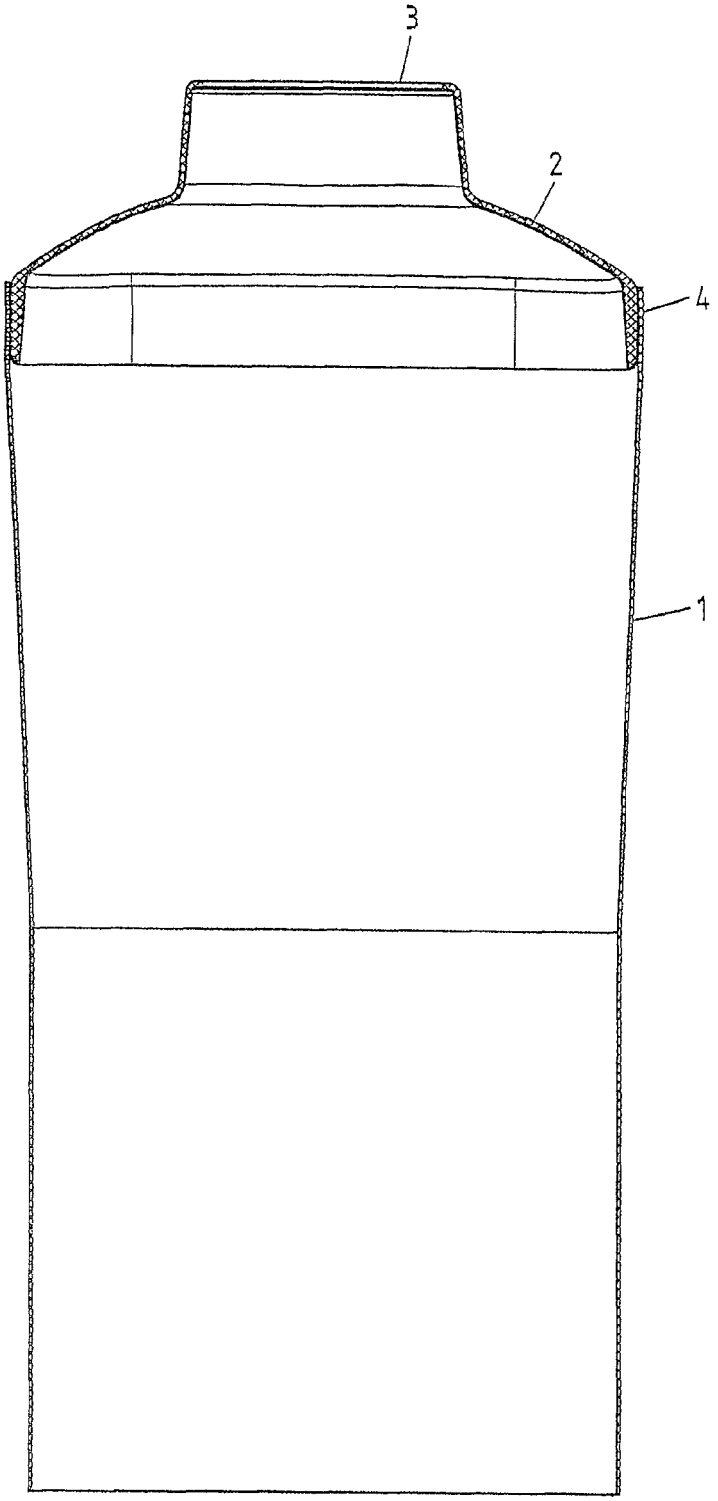
FIG. 2 shows the container from FIG. 1 in section along the line II-II.

FIG. 2 shows the container from FIG. 1 in a section along the line II-II. Here in the overlap region 4 in which the connection is formed between base body 1 and upper part 2, it can be clearly identified that the base body 1 surrounds the upper part 2 in the overlap region 4. Within the framework of the invention, however, an embodiment is also feasible in which the lower region of the upper part surrounds the base body.

The base body 1 has substantially the same cross-sectional area from the underside to the upper side. On the underside the cross-section of the base body 1 is substantially rectangular-shaped. The further the base body 1 extends from its underside to its upper side, the more the rectangular edges of the base body 1 go over into circular arc segments having increasingly larger radius, as can be deduced in particular from FIG. 3, where the container is shown in perspective view. On the upper side the cross-section of the base body 1 therefore only has rectangularly arranged side pieces which are interconnected by circular arc segments.

Figure 2A:
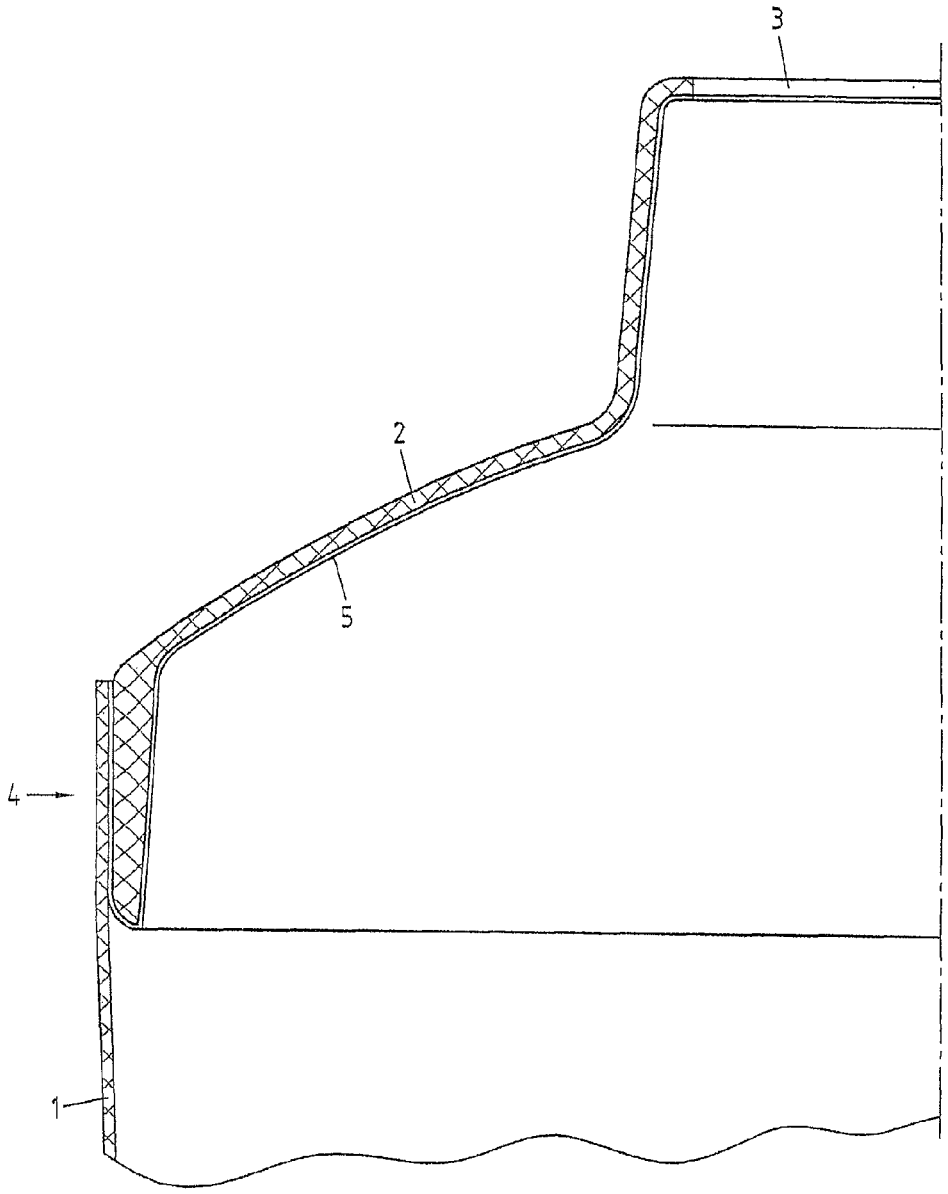
FIG. 2A shows an enlargement of the upper part from FIG. 2.

In order that the upper part 2 of the container is gas- and liquid-tight and can act as a barrier layer, said upper part is provided in its interior with a film 5 as can be clearly deduced from the enlarged view according to FIG. 2A. It can be clearly identified that the film 5 is drawn around the lower edge of the upper part 2, thus facilitating sealing of base body 1 and upper part 2 as well as protection of the edge from moisture. In a known manner, aluminium foil, SiOx, aluminium vapour deposition, polyamide (PA), ethylene vinyl alcohol (EVOH) or another barrier plastic can be used as barrier layer inside the film 5. PA and EVOH are preferred. In one aspect, the film 5 may be positioned between an interior surface of the base body 1 and an exterior surface of the fibrous moulding.

Figure 3:
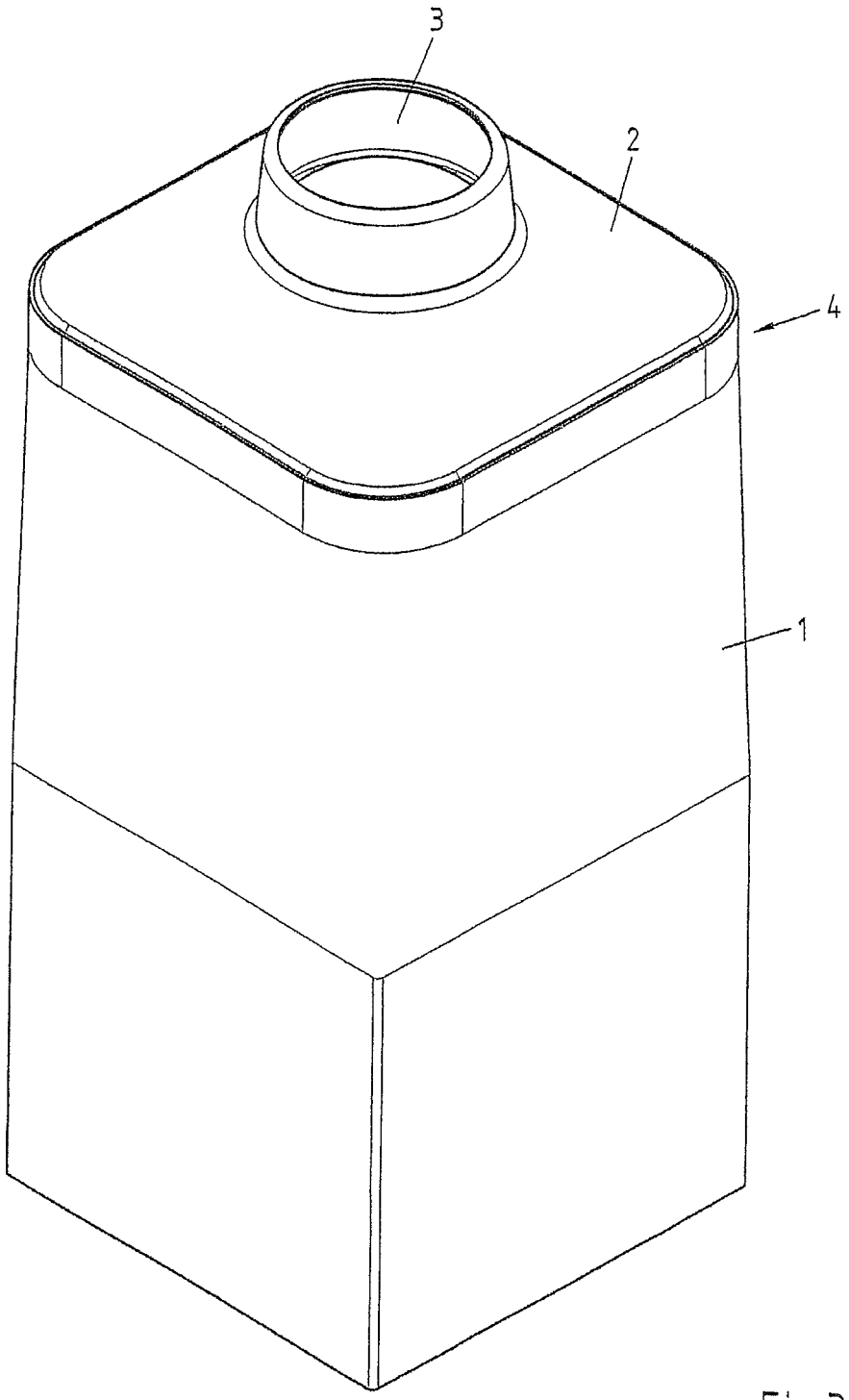
FIG. 3 shows the container in a perspective view.
Figure 4:
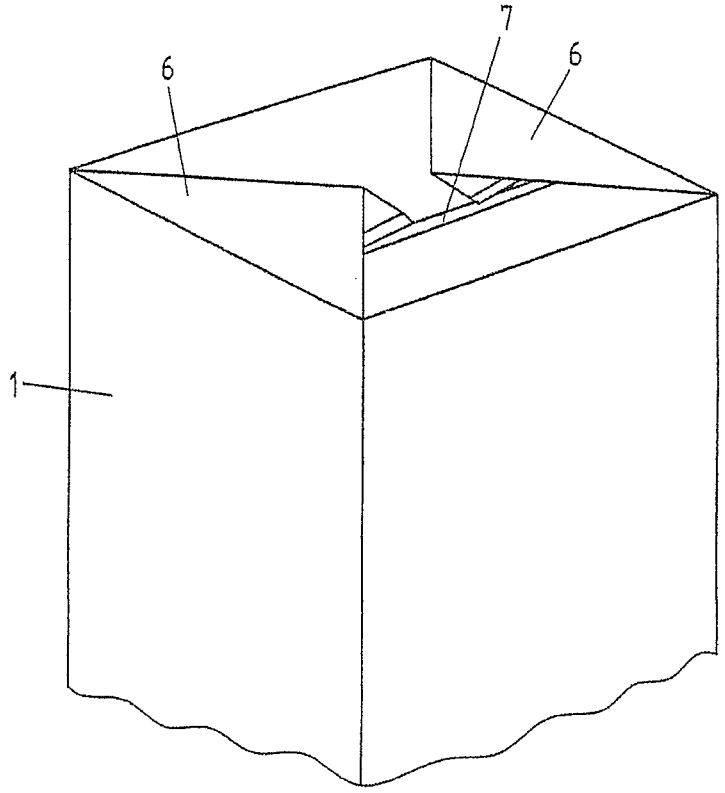
FIG. 4 shows the base of the container, in perspective view from below

FIG. 3 shows the container in perspective view. The base body 1 is closed on its underside. As already shown in FIG. 2, the base body 1 has a varying cross-sectional area in its course from bottom to top. The base can be closed by sealing and folding as shown in FIG. 4, where packaging ears 6 are placed onto the seam 7 at the base. It is not shown that the pouring element can also have a thread in the upper part 2 manufactured as a fibrous moulding. It is furthermore clear that the upper part 2 can also be coated from its upper side in order to be protected from external influences, in particular moisture.

Figure 5:
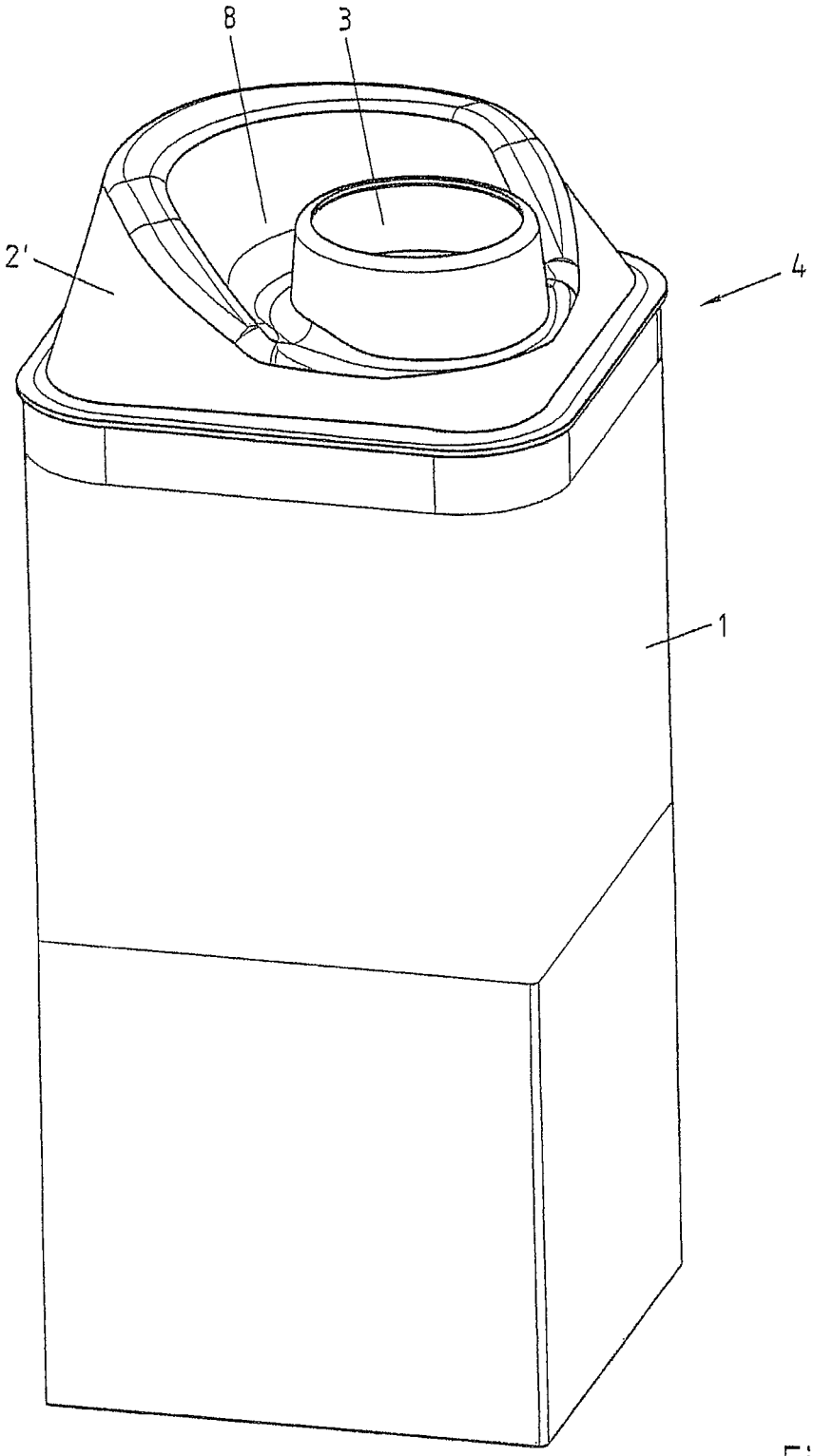
FIG. 5 shows another exemplary embodiment of another container in a perspective view.

FIG. 5 finally shows another exemplary embodiment of a container in perspective view in which the lower part 1 is identical to the aforesaid lower part 1 but the upper part 2' has a completely different geometry. There the substantially similarly constructed pouring element 3 is protected by a protuberance 8. However the connection between upper part 2' and base body 1 is made exactly as described previously in the connection region 4. As a result it is clear that when using upper parts—but also lower parts—made from fibrous mouldings, any shapes which cannot be produced by folding and sealing packaging laminate, can be achieved. In this way, the container according to the invention and the method for its manufacture comprise a plurality of feasible configurations.

The invention claimed is:

1. A container for receiving contents, in particular liquid foodstuffs, comprising a tubular base body and comprising at least one fibrous moulding connected to the base body, wherein the inner side of the at least one fibrous moulding is coated in a gas- and liquid-tight manner by means of a multilayer film which can also contain a barrier layer and wherein the film is guided around the edge of the fibrous moulding in an overlap region in which the film is positioned between an interior surface of the base body and an exterior surface of the fibrous moulding.

2. The container according to claim 1, wherein the base body is made of packaging laminate.

3. The container according to claim 2, wherein the packaging at least comprises a layer of board, paper, plastic or aluminum.

4. The container according to claim 1, wherein the at least one fibrous moulding is made from pulp.

5. The container according to claim 1, wherein the at least one fibrous moulding forms the upper part of the container.

6. The container according to claim 5, wherein the upper part of the container has a pouring opening.

7. The container according to claim 6, wherein the pouring opening is reclosable.

8. The container according to claim 1, wherein the fibrous moulding is the base part of the container.

9. The container according to claim 1, wherein the outer side of the at least one fibrous moulding is completely or partially provided with a coating.

10. A method for manufacturing a container including a base body and at least one fibrous moulding, the method comprising the following steps:

pressing at least one fibrous moulding from pulp, coating the inner sides of each fibrous moulding with a film as far as around the lower edge of the fibrous moulding in an overlap region, providing a tubular base body, joining the tubular base body to the fibrous moulding to produce a container open on one side, filling the container through the open side, and closing the container by folding or by joining to another fibrous moulding, wherein the film is coated around the lower edge of the fibrous moulding up to the overlap region in which the film is positioned between an interior surface of the base body and an exterior surface of the fibrous moulding.

11. A method for manufacturing a container including a base body and at least one fibrous moulding having a pouring opening, the method comprising the following steps:

pressing at least one fibrous moulding from pulp, coating the inner sides of each fibrous moulding with a film as far as around the lower edge of the fibrous moulding in an overlap region, providing a tubular base body, joining the tubular base body to the at least one fibrous moulding to produce a container, filling the container through the pouring opening, and closing the pouring opening, wherein the film is coated around the lower edge of the fibrous moulding up to the overlap region in which the film is positioned between an interior surface of the base body and an exterior surface of the fibrous moulding.

* * * * *